US009224557B2

(12) United States Patent
Mori et al.

(10) Patent No.: US 9,224,557 B2
(45) Date of Patent: Dec. 29, 2015

(54) SWITCH DEVICE

(71) Applicants: Koji Mori, Aichi (JP); Yuichi Fujii, Aichi (JP)

(72) Inventors: Koji Mori, Aichi (JP); Yuichi Fujii, Aichi (JP)

(73) Assignee: OMRON AUTOMOTIVE ELECTRONICS CO., LTD., Aichi (JP)

( * ) Notice: Subject to any disclaimer, the term of this patent is extended or adjusted under 35 U.S.C. 154(b) by 61 days.

(21) Appl. No.: 14/183,105

(22) Filed: Feb. 18, 2014

(65) Prior Publication Data

US 2014/0231233 A1 Aug. 21, 2014

(30) Foreign Application Priority Data

Feb. 19, 2013 (JP) ..... 2013-029973

(51) Int. Cl.
*H01H 23/06* (2006.01)
*H01H 21/08* (2006.01)
*H01H 21/22* (2006.01)

(52) U.S. Cl.
CPC ..... *H01H 23/06* (2013.01); *H01H 21/08* (2013.01); *H01H 2021/225* (2013.01); *H01H 2223/004* (2013.01); *H01H 2300/01* (2013.01)

(58) Field of Classification Search
CPC ..... H01H 13/70; H01H 23/06
USPC ..... 200/5 A, 302.1–302.3
See application file for complete search history.

(56) References Cited

U.S. PATENT DOCUMENTS 7,145,090 B2 12/2006 Shimizu
7,183,510 B2 2/2007 Ami et al.

FOREIGN PATENT DOCUMENTS

JP H11-86662 A 3/1999
JP 2006-221929 A 8/2006
JP 2006-331697 A 12/2006

OTHER PUBLICATIONS

Notification of Reasons for Refusal issued in corresponding Japanese Application No. 2013-029973, mailed on Dec. 26, 2014 (6 pages).

*Primary Examiner* — Edwin A. Leon
*Assistant Examiner* — Iman Malakooti
(74) *Attorney, Agent, or Firm* — Osha Liang LLP

(57) ABSTRACT

A switch device has an upper case, a hollow tube that is vertically opened and provided on an upper surface of the upper case, an operation knob that is swingably supported by the tube so as to cover an upper opening of the tube, and a lower case that is fitted in the upper case. The tube has a front sidewall and a back sidewall. The front sidewall and the back sidewall are opposed in front-back direction with the upper opening interposed therebetween. A drain groove extending along the back sidewall is formed at an upper end of the back sidewall. One of or both ends in a lengthwise direction of the drain groove are opened.

5 Claims, 12 Drawing Sheets

SWITCH DEVICE

BACKGROUND OF THE INVENTION

1. Technical Field

The present invention relates to a switch device provided with a waterproof structure that prevents water from invasion from outside.

2. Related Art

An automobile includes an automatic window switch in order to perform opening and closing control of a window. Generally the automatic window switch includes an operation knob that is manually operated, a case that swingably supports the operation knob, and a circuit board that is accommodated in the case. The case includes an upper case and a lower case. An operation part is provided on an upper side of the upper case, and a lower side of the upper case is opened. The lower case is fitted in the upper case so as to close the lower side of the upper case. A contact part that switches in response to the operation of the operation knob and an electronic component constituting an electric circuit are provided on the circuit board.

In the automatic window switch, sometimes rainwater invading through an opened window or spilled beverages (hereinafter collectively referred to as "water") invade into the case. The water invading into the case adheres to the circuit board to generate shortcircuit of the electric circuit or corrosion of the contact part, which causes a malfunction of the switch. Particularly, in the case that a hollow tube that swingably supports the operation knob is provided in an upper surface of the case, unfortunately the flowing-down water invades into the case from an upper opening of the tube through a gap between the operation knob and the tube.

Japanese Unexamined Patent Publication Nos. 11-86662 and 2006-221929 disclose structures, which prevent shortcircuit or contact corrosion from the invading water in the switch device in which the hollow tube supporting the operation knob is provided in the upper surface of the case.

In the switch device of Japanese Unexamined Patent Publication No. 11-86662, a rubber contact member is stacked on a circuit board, to which a terminal of a component is connected by soldering, so as to surround the soldered portion, and the rubber contact member is sandwiched between the circuit board and a switch body, thereby taking a waterproof measure.

In the switch device of Japanese Unexamined Patent Publication No. 2006-221929, a projection that blocks the invasion of water is provided in an outer side surface of the tube opposed to an inner side surface of the operation knob or the inner side surface of the operation knob opposed to the outer side surface of the tube. Additionally, plural grooves that block the invasion of water are vertically provided in the outer side surface of the tube opposed to the inner side surface of the operation knob.

SUMMARY

One or more embodiments of the present invention suppresses the invasion of water from behind the operation knob through the gap between the knob and the tube in the switch device in which the hollow tube supporting the operation knob is provided in the upper surface of the case.

In accordance with one or more embodiments of the present invention, a switch device includes: an upper case; a hollow tube that is vertically opened while provided on an upper surface of the upper case; an operation knob that is swingably supported by the tube so as to cover an upper opening of the tube; and a lower case that is fitted in the upper case. In the switch device, the tube includes a front sidewall and a back sidewall, the front sidewall and the back sidewall being opposed in front-back direction with the upper opening interposed therebetween, a drain groove extending along the back sidewall is formed at an upper end of the back sidewall, and one of or both ends in a lengthwise direction of the drain groove are opened.

According to the above structure, even if flowing-down water invades into the gap between the operation knob and the tube from behind the operation knob, the water is laterally drained from one of or both the ends of the drain groove after flowing in the drain groove. Therefore, the water can be prevented from invading into the switch device from the upper opening of the tube through the gap between the operation knob and the tube.

In the switch device, the upper end of the back sidewall may be opposed to a rear end of the operation knob, and the drain groove may be covered with the rear end of the operation knob.

In the switch device, a recess opposed to the drain groove may be formed at the rear end of the operation knob.

In the switch device, a first wall portion and a second wall portion may be formed at the upper end of the back sidewall with the drain groove interposed therebetween, and a third wall portion opposed to the first wall portion and a fourth wall portion opposed to the second wall portion may be formed at the rear end of the operation knob with the recess interposed therebetween.

In the switch device, during a non-operation of the operation knob, a front end of the first wall portion and a front end of the third wall portion may be in contact with each other, or a front end of the second wall portion and a front end of the fourth wall portion may be in contact with each other.

In the switch device, during a non-operation of the operation knob, a front end of the first wall portion and a front end of the third wall portion may be in contact with each other, and a front end of the second wall portion and a front end of the fourth wall portion may be in contact with each other.

Accordingly, one or more embodiments of the present invention can provide the switch device that prevents the water from invading from behind the operation knob through the gap between the knob and the tube.

DETAILED DESCRIPTION

Figure 1:
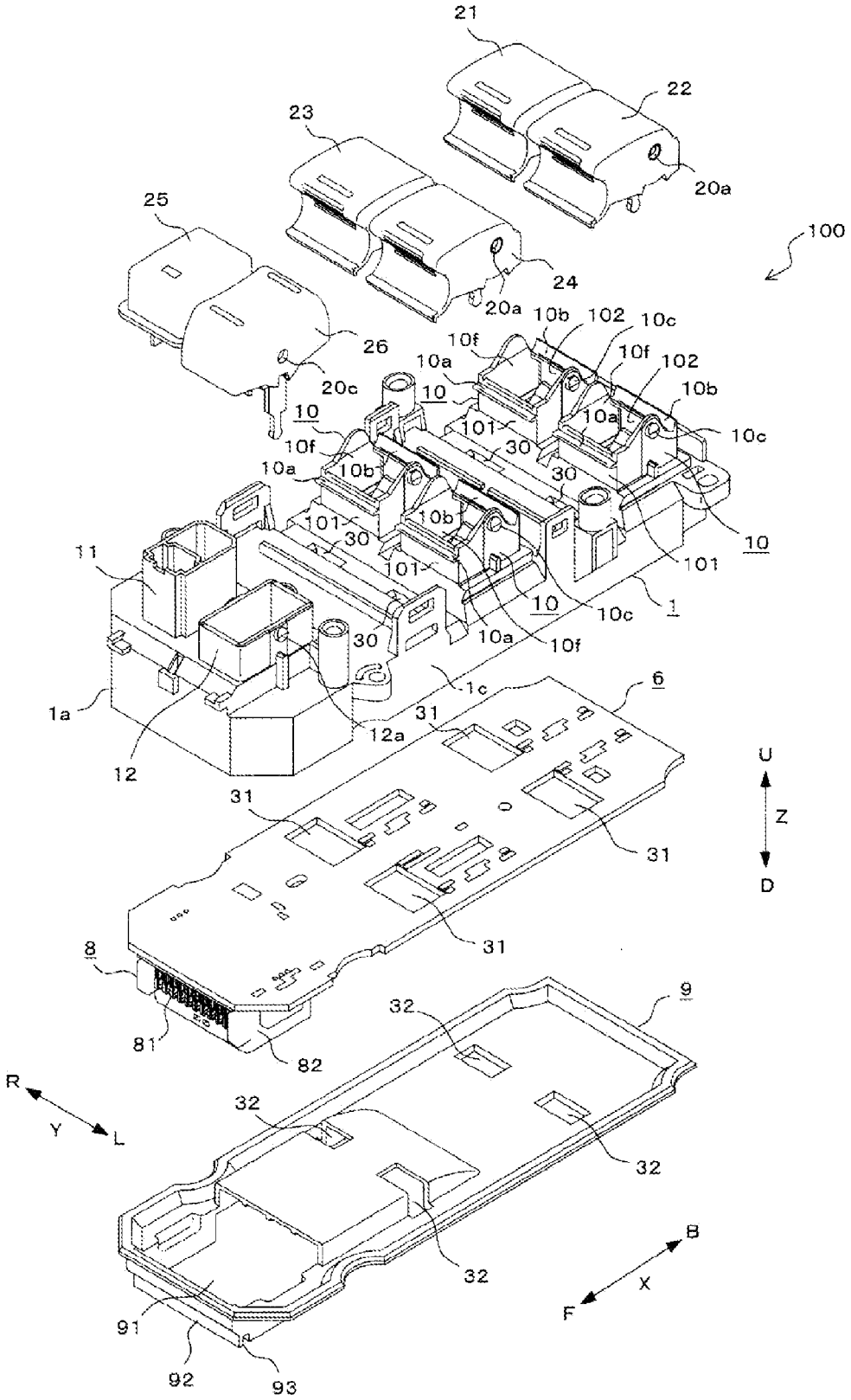
FIG. 1 is an exploded perspective view illustrating a switch device according to one or more embodiments of the present invention.

Hereinafter, embodiments of the present invention will be described with reference to the drawings. In the drawings, the identical or equivalent components are designated by an identical numeral. The symbol X indicated by an arrow expresses a front-back direction, the symbol Y expresses a horizontal direction, and the symbol Z expresses a vertical direction. The symbol F in the X-direction expresses a frontward direction, the symbol B expresses a backward direction, the symbol L in the Y-direction expresses a leftward direction, the symbol R expresses a rightward direction, the symbol U in the Z-direction expresses an upward direction, and the symbol D expresses a downward direction. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 2:
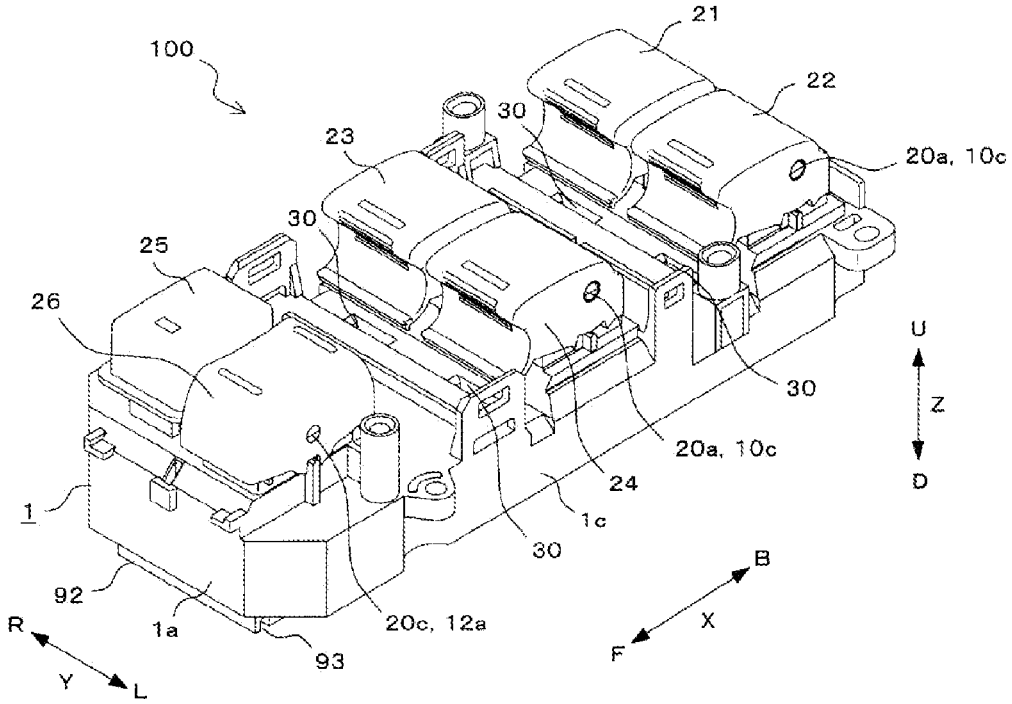
FIG. 2 is an assembly drawing of the switch device in FIG. 1.

A switch device 100 is a vehicle automatic window switch that is attached to, for example, an armrest (not illustrated) provided inside a door of a driver's seat. As illustrated in FIGS. 1 and 2, the switch device 100 includes plural operation knobs 21 to 26, an upper case 1 to which the operation knobs 21 to 26 are attached, a lower case 9 that is fitted in the upper case 1, and a circuit board 6 that is accommodated in an internal space S (see FIG. 8) formed by the upper case 1 and the lower case 9.

Figure 3:
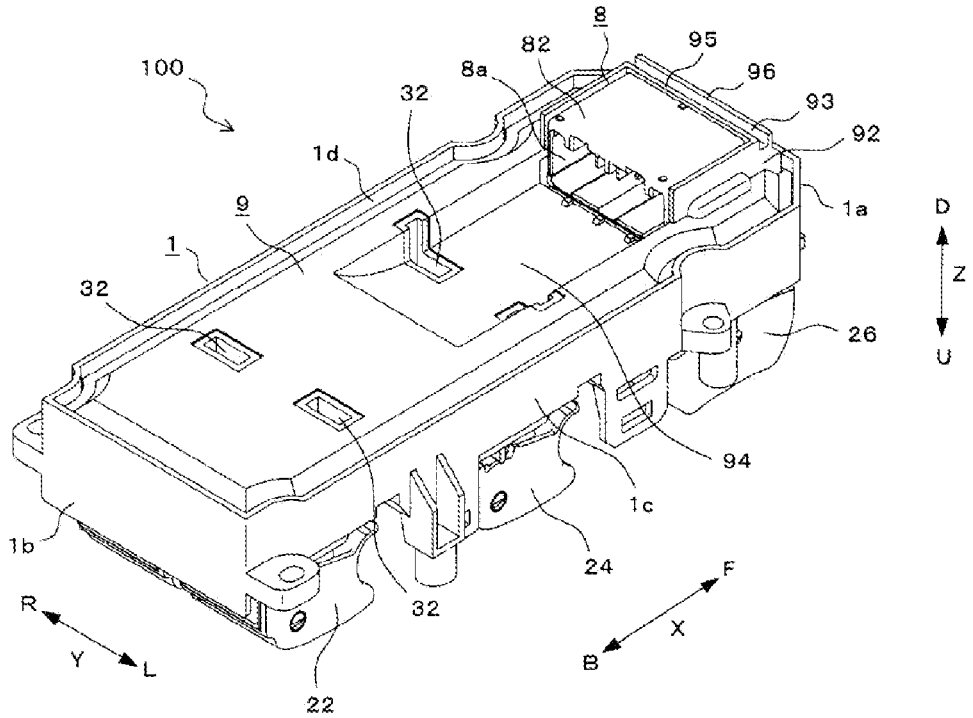
FIG. 3 is a view of the switch device in FIG. 2 when viewed from a rear side.
Figure 4:
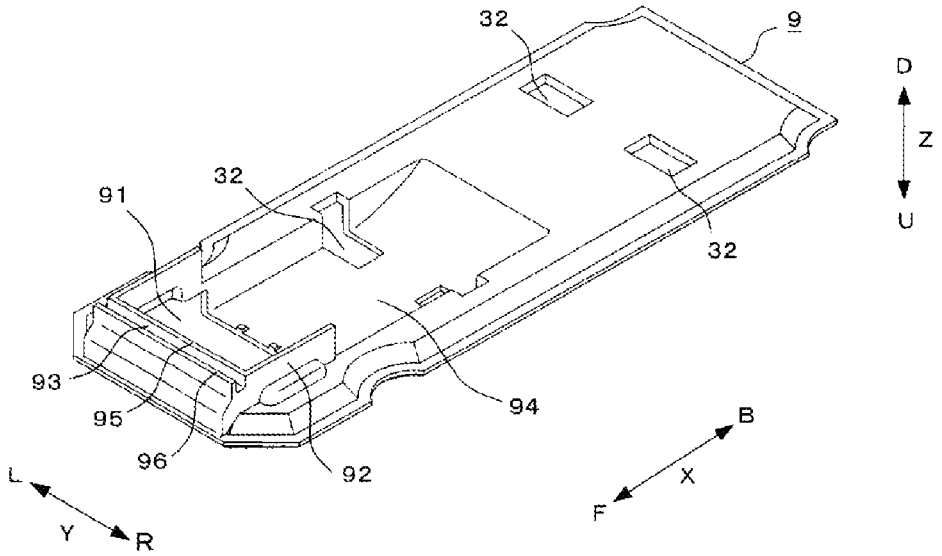
FIG. 4 is a perspective view of a lower case.
Figure 5:
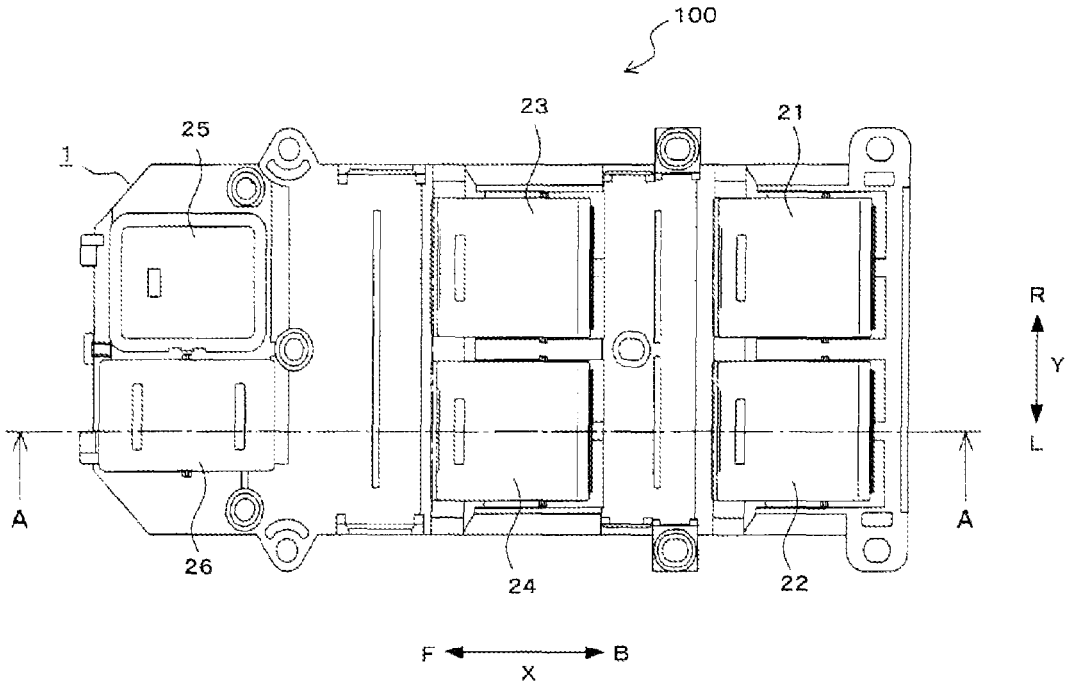
FIG. 5 is a plan view of the switch device in FIG. 1.
Figure 6:
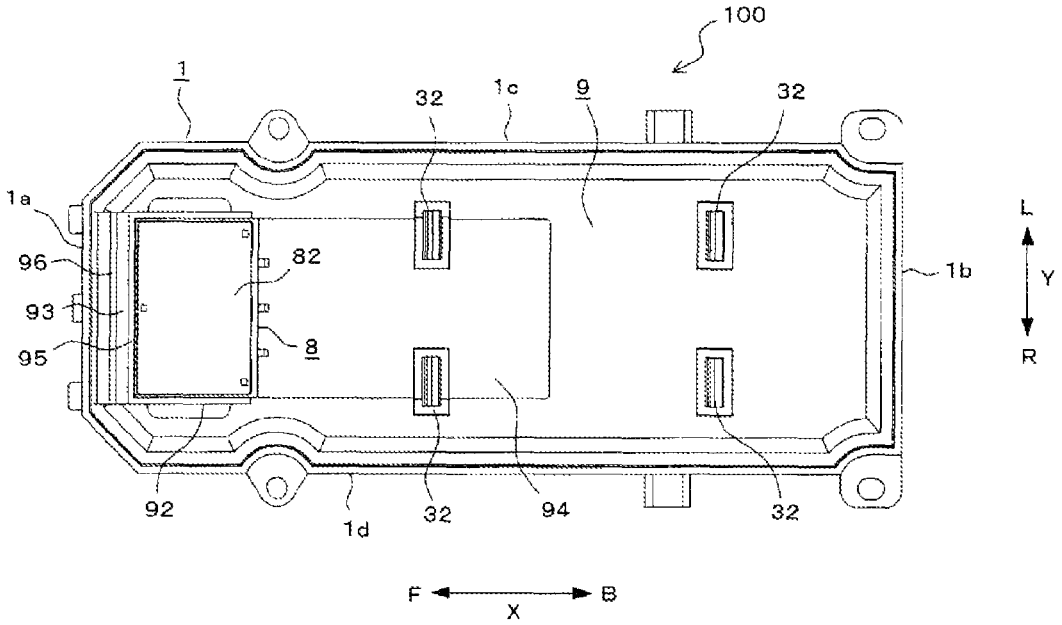
FIG. 6 is a rear view of the switch device in FIG. 1.
Figure 7:
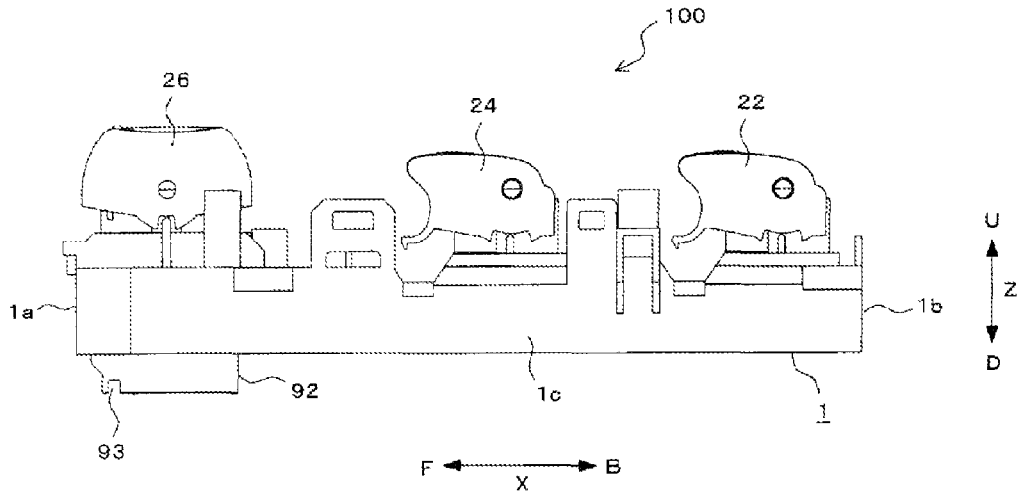
FIG. 7 is a side view of the switch device in FIG. 1.

The upper case 1 is formed into a box shape including four sidewalls 1*a* to 1*d* (see FIG. 3). A lower side (D-direction side) of the upper case 1 is opened. The lower case 9 is formed into a flat shape, and fitted in the upper case 1 to close the lower side of the upper case 1. For example, the lower case 9 can be fitted in the upper case 1 by such a well-known method that a protrusion (not illustrated) formed in the lower case 9 is engaged in a notch (not illustrated) formed in the upper case 1.

The operation knobs 21 to 24 are attached to four hollow tubes 10 provided on an upper surface of the upper case 1. Particularly, shaft portions 10*c* formed in the tubes 10 of the upper case 1 are fitted in holes 20*a* formed in the operation knobs 21 to 24, whereby the operation knobs 21 to 24 are swingably supported about the shaft portions 10*c* so as to cover upper openings 10*f* of the tubes 10. For example, the operation knobs 21 to 24 are operated in the case that windows of the driver's seat, a passenger's seat, a left rear seat, and a right rear seat are opened and closed.

The push-type operation knob 25 is supported by a hollow tube 11, which is provided on the upper surface of the upper case 1, while being vertically movable. For example, the operation knob 25 is operated in the case that the windows of the passenger's seat and the rear seats are prohibited to be opened and closed or in the case that the prohibition is lifted.

The seesaw-type operation knob 26 is attached to a hollow tube 12 provided on the upper surface of the upper case 1. Particularly, a shaft portion 12*a* formed in the tube 12 of the upper case 1 is fitted in a hole 20*c* formed in the operation knob 26, whereby the operation knob 26 is swingably supported about the shaft portion 12*a*. For example, the operation knob 26 is operated in the case that the door of each seat is locked or unlocked.

As illustrated in FIG. 1, in the upper surface of the upper case 1, rectangular drain holes 30 are provided near the tubes 10 supporting the operation knobs 21 to 24. Particularly, two drain holes 30 arrayed in the horizontal direction Y are provided between the back-side tubes 10 supporting the operation knobs 21 and 22 and the front-side tubes 10 supporting the operation knobs 23 and 24. Two drain holes 30 arrayed in the horizontal direction Y are also provided between the front-side tubes 10 supporting the operation knobs 23 and 24 and the tubes 11 and 12 supporting the operation knobs 25 and 26.

A circuit board 6 is constructed by a printed wiring board, and a connector 8 is mounted at an end on a rear side of the circuit board 6. The connector 8 includes a connector terminal 81 that is connected to the circuit board 6 and a connector box 82 that accommodates the connector terminal 81 therein. As illustrated in FIG. 3, the connector box 82 includes an opening 8*a* that is opened in the direction (X-direction) parallel to a lower surface of the lower case 9. A terminal (not illustrated) of a cable is inserted in the opening 8*a* in order to connect the circuit board 6 to an external control device. A switch contact (not illustrated) that switches in response to the operations of the operation knobs 21 to 26 and an electronic component (not illustrated) constituting an electric circuit are also mounted on the circuit board 6 in addition to the connector 8. In the circuit board 6, rectangular through-holes 31 are formed at places corresponding to the drain holes 30 of the upper case 1.

As illustrated in FIG. 1, a window 91 is formed in the place corresponding to the connector 8 of the lower case 9. The connector 8 is exposed from the window 91 onto the rear side of the lower case 9. In the lower case 9, rectangular drain holes 32 opened downward are formed at the places corresponding to the drain holes 30 of the upper case 1 and the through-holes 31 of the circuit board 6.

Figure 8:
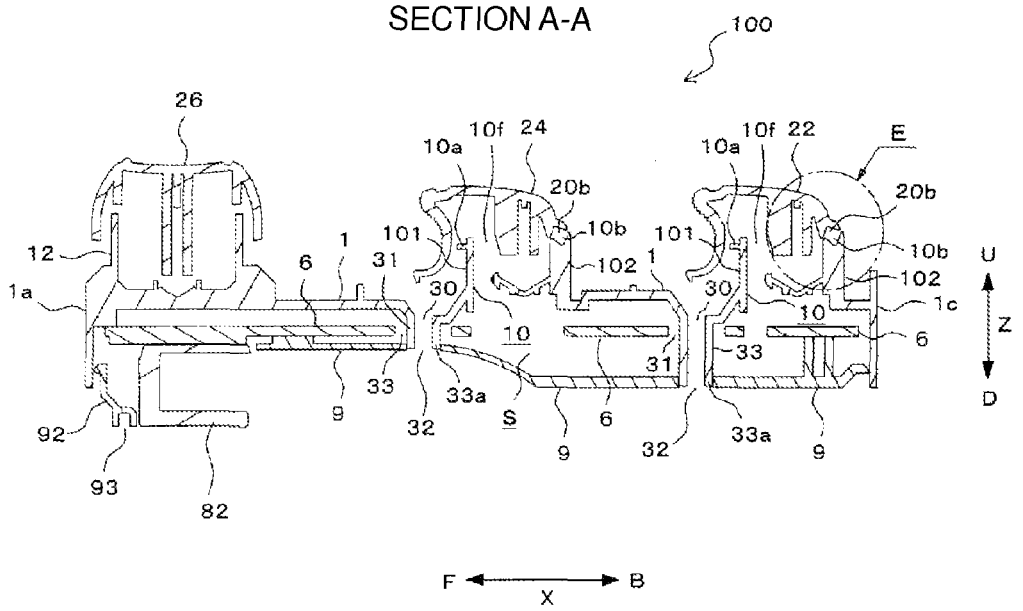
FIG. 8 is a cross-sectional view taken on line A-A in FIG. 5.

As illustrated in FIG. 8, the drain hole 30 is opened upward, and the drain hole 32 is opened downward. The drain hole 30 and the drain hole 32 are communicated with each other through a hollow drain pipe 33. The drain pipe 33 is formed while being integral with the upper case 1, and pierces the through-hole 31 of the circuit board 6. A front end (lower end) 33*a* of the drain pipe 33 extends to the drain hole 32 of the lower case 9, and is fitted in the drain hole 32.

As illustrated in FIG. 3, a projection wall 92 projecting downward (D-direction) is provided on the lower surface of the lower case 9 so as to cover three side surfaces (except opening 8*a*) of the connector box 82. The projection wall 92 is molded by resin while being integral with the lower case 9. A wall portion 95, a wall portion 96, and a groove portion 93 are formed in the projection wall 92. A recess 94 in which a cable (not illustrated) connected to the connector 8 is accommodated is formed on the lower surface of the lower case 9.

Figure 10:
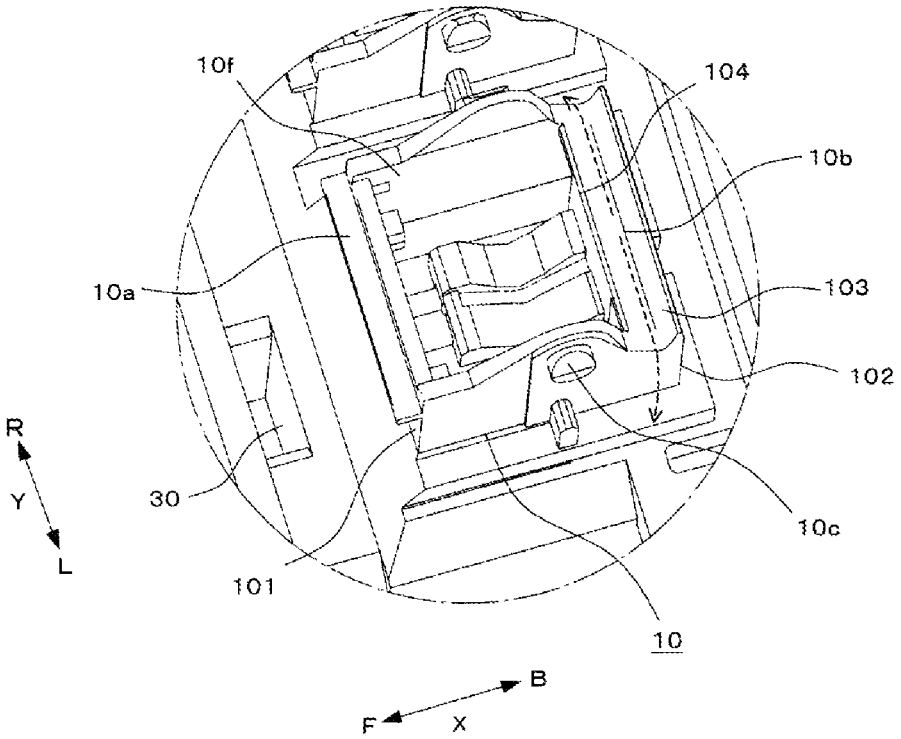
FIG. 10 is an enlarged perspective view of a vicinity of a tube.
Figure 11:
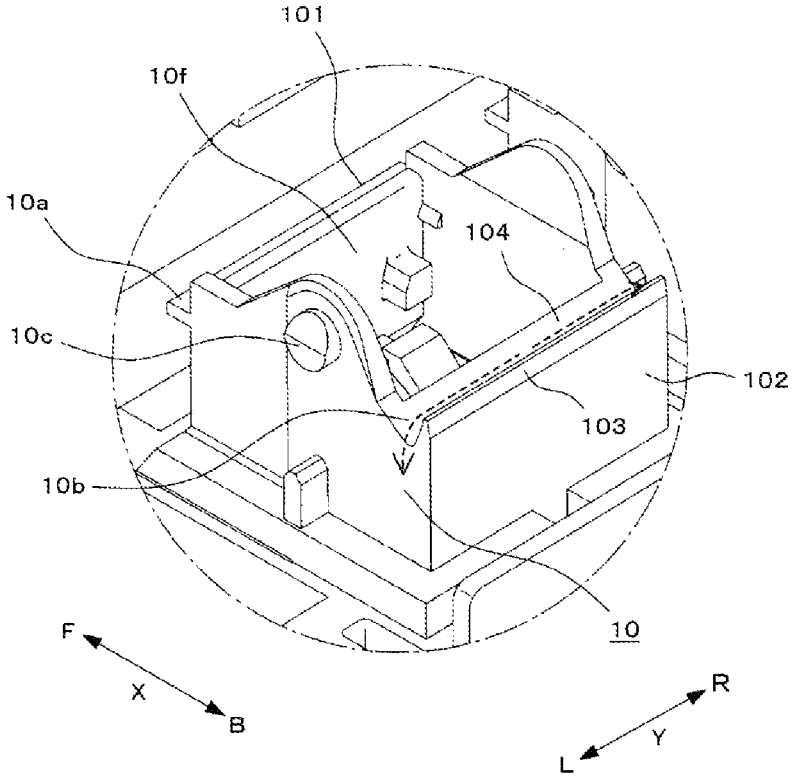
FIG. 11 is an enlarged perspective view of the vicinity of the tube when viewed from another direction.

As illustrated in FIG. 8, the tube 10 includes a front sidewall 101 and a back sidewall 102, and the front sidewall 101 and the back sidewall 102 are opposed to each other in the front-back direction X with the upper opening 10*f* interposed therebetween. A rib 10*a* projecting forward (F-direction) is formed in the front sidewall 101. As illustrated in FIGS. 1, 10, and 11, the rib 10*a* extends along the front sidewall 101, and has the same length as a width in the Y-direction of the front sidewall 101.

As illustrated in FIG. 8, a drain groove 10*b* opened upward (U-direction) is formed at an upper end of the back sidewall 102. The drain groove 10*b* has a V-shape in section. As illustrated in FIGS. 1, 10, and 11, the drain groove 10*b* extends along the back sidewall 102, and has the same length as the width in the Y-direction of the back sidewall 102. As illustrated in FIG. 10, both ends in a lengthwise direction (Y-direction) of the drain groove 10*b* are opened. As illustrated in FIG. 8, a recess 20*b* opposed to the drain groove 10*b* is formed at a rear end of each of the operation knobs 21 to 24. The recess 20*b* has an inverse V-shape in section.

Figure 9:
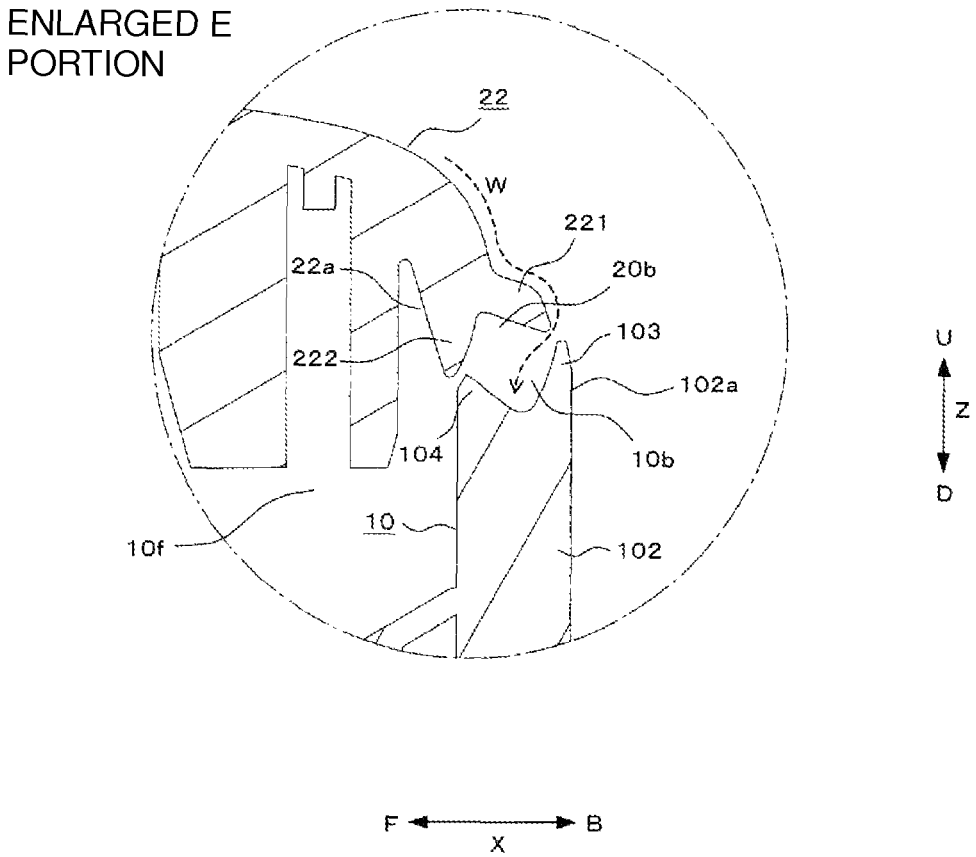
FIG. 9 is an enlarged cross-sectional view of E portion in FIG. 8.

FIG. 9 is an enlarged cross-sectional view of E portion in FIG. 8. At this point, only the operation knob 22 is illustrated in FIG. 9, and the same holds true for other operation knobs 21, 23, and 24. Accordingly, only the operation knob 22 is described below. Referring to FIG. 9, an upper end 102*a* of the back sidewall 102 is opposed to a rear end 22*a* of the operation knob 22. At the upper end 102*a* of the back sidewall 102, a wall portion 103 (first wall portion) and a wall portion 104 (second wall portion) are formed with the drain groove 10*b* interposed therebetween. At the rear end 22*a* of the operation knob 22, a wall portion 221 (third wall portion) opposed to the wall portion 103 and a wall portion 222 (fourth wall portion) opposed to the wall portion 104 are formed with the recess 20*b* interposed therebetween.

Figure 12:
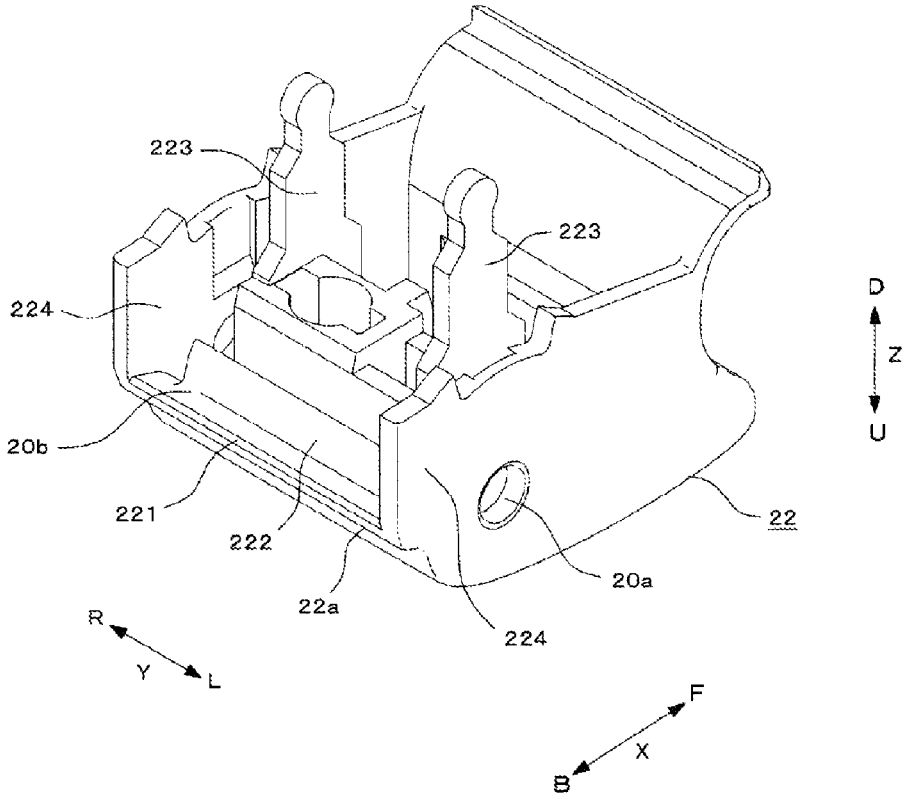
FIG. 12 is a perspective view of an operation knob.
Figure 13:
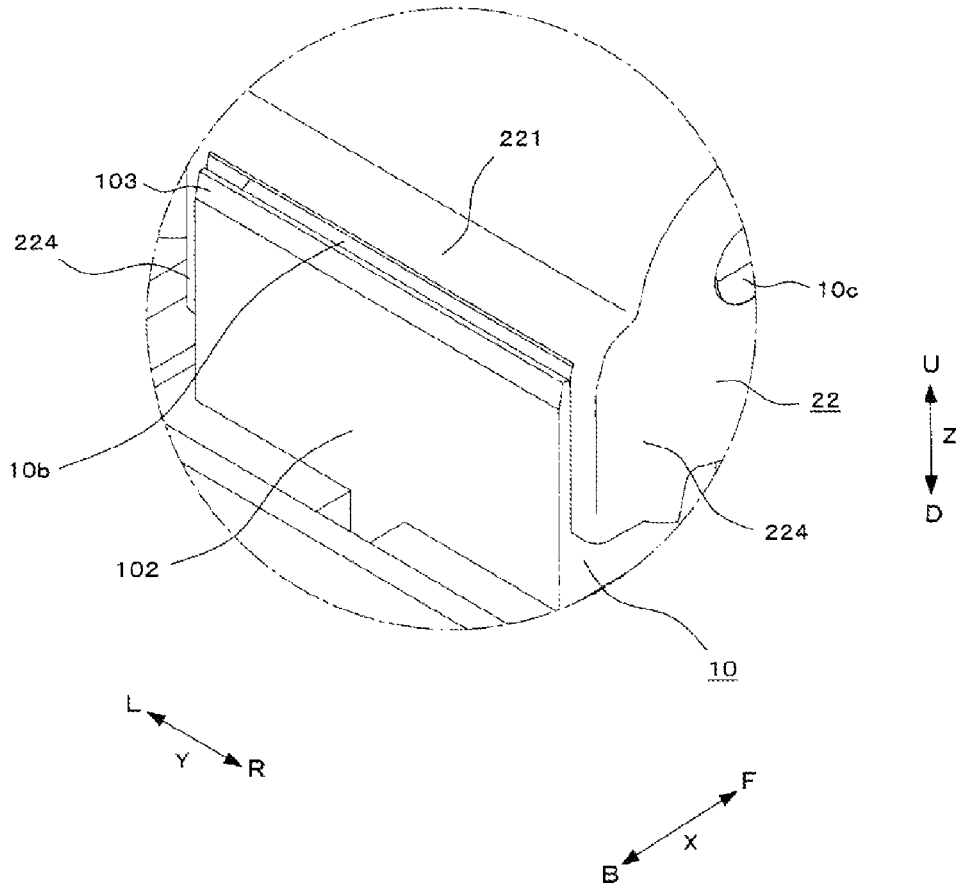
FIG. 13 is an enlarged perspective view of a back portion of the operation knob.

FIG. 12 is a view of the operation knob 22 when viewed from the rear side. An operation piece 223 is used to operate a switch mechanism (not illustrated). A pair of sidewalls 224 is provided on both sides of the wall portions 221 and 222. As illustrated in FIG. 13, the sidewalls 224 are located on both the sides of the back sidewall 102 of the tube 10 while the operation knob 22 is attached to the tube 10.

In one or more embodiments of the present invention, the drain groove 10*b* is formed at the upper end 102*a* of the back sidewall 102 of the tube 10, and both the ends in the lengthwise direction of the drain groove 10*b* are opened. In FIG. 9, even if the flowing-down water invades between the operation knob 22 and the tube 10 from behind the operation knob 22 through a pathway indicated by a dashed line W, the water flows into the drain groove 10*b*. Then the inflow water is drained in a lateral direction (L-direction and R-direction) from both the ends of the drain groove 10*b* as indicated by dashed lines in FIGS. 10 and 11. Therefore, the water can be prevented from invading into the internal space S of the switch device 100 from the upper opening 10*f* of the tube 10 through the gap between the operation knob 22 and the tube 10.

In one or more embodiments of the present invention, the upper end 102*a* of the back sidewall 102 and the wall portion 221 overhung backward from the operation knob 22 are disposed so as to be opposed to each other. The drain groove 10*b* is covered from above by the back-side wall portion 221 and a front-side wall portion 222 of the operation knob 22 (see FIG. 9). Therefore, an amount of water flowing in the drain groove 10*b* from the back side of the operation knob 22 is suppressed, and the inflow water hardly invades into the upper opening 10*f* beyond the wall portion 104.

In one or more embodiments of the present invention, the recess 20*b* opposed to the drain groove 10*b* of the back sidewall 102 is formed at the rear end 22*a* of the operation knob 22. Therefore, the front end of the wall portion 104 enters the recess 20*b* in the case that the operation knob 22 turns clockwise in FIG. 9. The rear end 22*a* of the operation knob 22 can be avoided jamming caused by a collision with the wall portion 104, and the operation to turn the operation knob 22 clockwise can smoothly be performed.

In one or more embodiments of the present invention, the rib 10*a* is provided in the front sidewall 101 of the tube 10. Therefore, the rib 10*a* can prevent the water from invading into the internal space S of the switch device 100 from the front of the operation knob 22 through the gap between the operation knob 22 and the tube 10 and the upper opening 10*f* of the tube 10.

In one or more embodiments of the present invention, the drain hole 30 is provided near the tube 10 of the upper case 1, the drain hole 32 is provided in the lower case 9 at the position corresponding to the drain hole 30, and the drain hole 30 and the drain hole 32 are communicated with each other through the drain pipe 33. Therefore, the flowing-down water can be drained downward through the drain hole 30, the drain pipe 33, and the drain hole 32.

In one or more embodiments of the present invention, the wall portions 95 and 96 are provided near the connector box 82, and the groove portion 93 is formed between the wall portions 95 and 96. Even if the water flowing down along the sidewall 1*a* of the upper case 1 is about to flow along the lower surface of the connector box 82, the water is blocked by the groove portion 93. Therefore, the water does not go round the opening 8*a* of the connector box 82, but the water can be prevented from invading into the connector 8 or the switch device 100 from the opening 8*a*.

Figure 14:
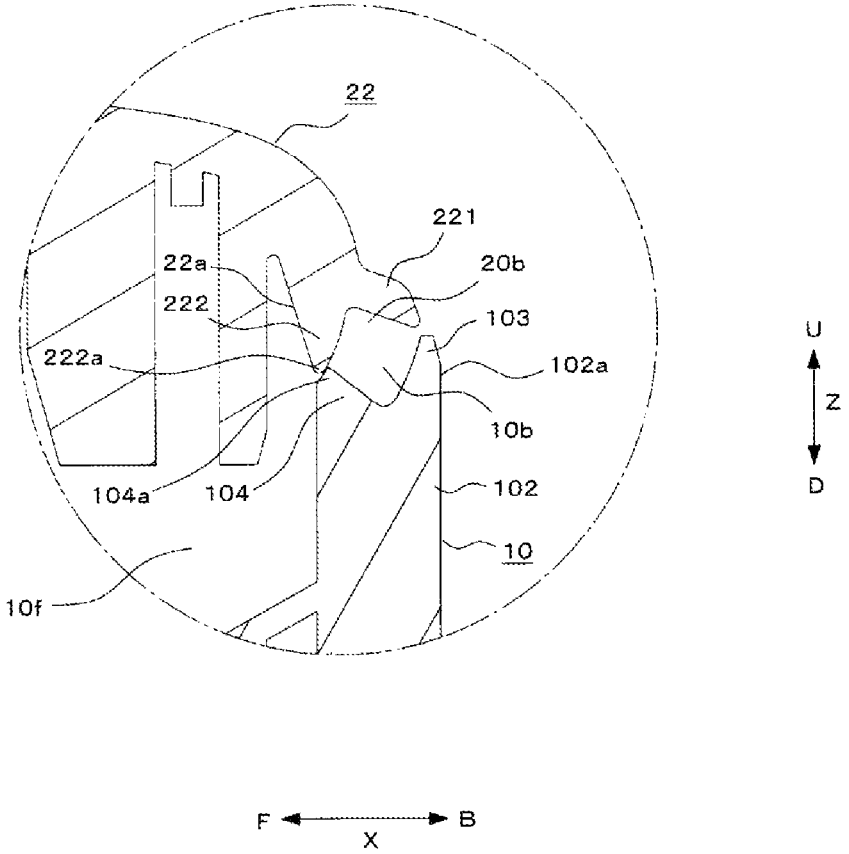
FIG. 14 is a cross-sectional view illustrating a main portion of one or more embodiments of the present invention.

FIG. 14 illustrates one or more embodiments of the present invention. In FIG. 14, a front end 104*a* of the wall portion 104 formed in the back sidewall 102 and a front end 222*a* of the wall portion 222 formed in the operation knob 22 are in contact with each other during a non-operation of the operation knob 22. Therefore, the water invasion pathway from the drain groove 10*b* to the upper opening 10*f* of the tube 10 is blocked by the contact portion of the wall portions 104 and 222, so that the water can more effectively be prevented from invading through the upper opening 10*f* during the non-operation of the operation knob 22.

Alternatively, the front end of the wall portion 103 formed in the back sidewall 102 and the front end of the wall portion 221 formed in the operation knob 22 may be in contact with each other during the non-operation of the operation knob 22 (not illustrated). Therefore, the water invading from behind the operation knob 22 can be blocked in front of the drain groove 10*b*. Even if the water flows beyond the contact portion of the wall portions 103 and 221, the water laterally drained after flowing into the drain groove 10*b*. Therefore, the water can more effectively be prevented from invading through the upper opening 10*f* during the non-operation of the operation knob 22.

Figure 15:
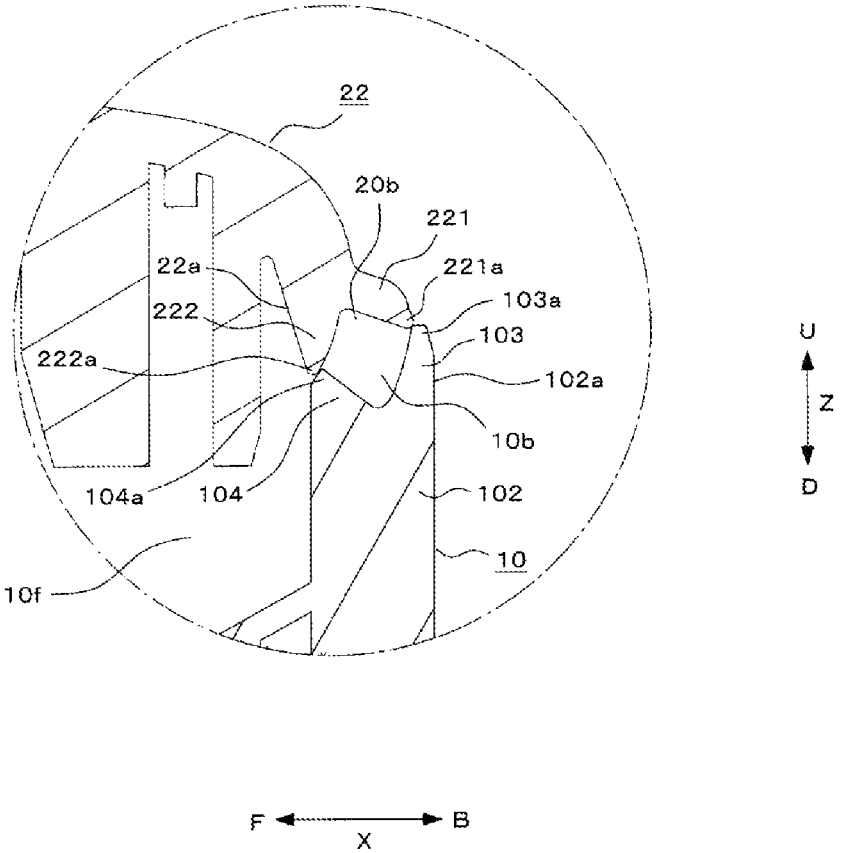
FIG. 15 is a cross-sectional view illustrating a main portion of one or more embodiments of the present invention.

FIG. 15 illustrates one or more embodiments of the present invention. In FIG. 15, during the non-operation of the operation knob 22, a front end 103*a* of the wall portion 103 of the back sidewall 102 and a front end 221*a* of the wall portion 221 of the operation knob 22 are in contact with each other, and a front end 104*a* of the wall portion 104 of the back sidewall 102 and a front end 222*a* of the wall portion 222 of the operation knob 22 are in contact with each other. The water invading from behind the operation knob 22 can be blocked in front of the drain groove 10*b* by the wall portions 103 and 221, and the water that cannot be blocked by the wall portions 103 and 221 can be caused to flow into the drain groove 10*b* and laterally drained. Additionally, the water invasion pathway from the drain groove 10*b* to the upper opening 10*f* is blocked by the wall portions 104 and 222. Therefore, the water can more effectively be prevented from invading through the upper opening 10*f* during the non-operation of the operation knob 22.

In addition to the above embodiments, various modifications can be employed in the present invention. For example, in one or more of the above embodiments, the drain groove 10*b* is formed into the V-shape in section. Alternatively, the drain groove 10*b* may be formed into other shapes, such as a U-shape, in section. The recess 20*b* of the operation knob 22 is not limited to the inverse V-shape, but the recess 20*b* may be formed into other shapes such as an inverse U-shape.

In one or more of the above embodiments, both the ends in the lengthwise direction of the drain groove 10*b* are opened by way of example. Alternatively, only one of the ends in the lengthwise direction of the drain groove 10*b* may be opened.

In one or more of the above embodiments, the drain groove 10*b* is horizontally formed by way of example. Alternatively, a slope (not illustrated) may be provided downward in the drain groove 10*b* in order to easily drain the water from the lateral side.

In FIG. 13, the sidewall 224 of the operation knob 22 extends to the both the ends of the back sidewall 102 of the tube 10. Alternatively, the back side (B-direction side) of the sidewall 224 may be cut out to open both the ends of the back sidewall 102. Therefore, the water is easily drained in the lateral direction from the drain groove 10*b*. Alternatively, a drain notch may be formed in the portion opposed to the drain groove 10*b* of the sidewall 224 such that the water is easily drained.

In one or more of the above embodiments, the switch device 100 includes six operation knobs 21 to 26 by way of example. However, the number of operation knobs is not limited to six. The structure of the operation knob is not limited to those in the drawings. For example, one or more embodiments of the present invention can also be applied to the switch device including a rotary operation knob.

In one or more of the above embodiments, the vehicle automatic window switch is cited as an example of the switch device 100. Additionally, one or more embodiments of the present invention can also be applied to the switch devices used in applications except the vehicle.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A switch device comprising:

an upper case;

a hollow tube that is vertically opened and provided on an upper surface of the upper case;

an operation knob that is swingably supported by the tube so as to cover an upper opening of the tube; and a lower case that is fitted in the upper case, wherein the tube comprises a front sidewall and a back sidewall, wherein the front sidewall and the back sidewall are opposed in front-back direction with the upper opening interposed therebetween, wherein a drain groove extending along the back sidewall is formed at an upper end of the back sidewall, wherein one of or both ends in a lengthwise direction of the drain groove are opened, wherein the upper end of the back sidewall is opposed to a rear end of the operation knob, wherein the drain groove is covered with the rear end of the operation knob, wherein a recess opposed to the drain groove is formed at the rear end of the operation knob, wherein a first wall portion and a second wall portion are formed at the upper end of the back sidewall with the drain groove interposed therebetween, wherein a third wall portion opposed to the first wall portion and a fourth wall portion opposed to the second wall portion are formed at the rear end of the operation knob with the recess interposed therebetween, wherein, during a non-operation of the operation knob, a front end of the second wall portion formed at the upper end of the back sidewall does not enter the recess formed at the rear end of the operation knob, and wherein the front end of the second wall portion enters the recess when the operation knob is operated to turn such that the rear end of the operation knob approaches the back sidewall of the tube.

2. The switch device according to claim 1, wherein, during a non-operation of the operation knob, a front end of the first wall portion and a front end of the third wall portion are in contact with each other, or a front end of the second wall portion and a front end of the fourth wall portion are in contact with each other.

3. The switch device according to claim 1, wherein, during a non-operation of the operation knob, a front end of the first wall portion and a front end of the third wall portion are in contact with each other, and a front end of the second wall portion and a front end of the fourth wall portion are in contact with each other.

4. A switch device comprising;

an upper case;

a hollow tube that is vertically opened and provided on an upper surface of the upper case;

an operation knob that is swingably supported by the tube so as to cover an upper opening of the tube; and a lower case that is fitted in the upper case, wherein the tube comprises a front sidewall and a back sidewall, wherein the front sidewall and the back sidewall are opposed in front-back direction with the upper opening interposed therebetween, wherein a drain groove extending along the back sidewall is formed at an upper end of the back sidewall, wherein one of or both ends in a lengthwise direction of the drain groove are opened, wherein the upper end of the back sidewall is opposed to a rear end of the operation knob, wherein the drain groove is covered with the rear end of the operation knob wherein a recess opposed to the drain groove is formed at the rear end of the operation knob wherein a first wall portion and a second wall portion are formed at the upper end of the back sidewall with the drain groove interposed therebetween, and wherein a third wall portion opposed to the first wall portion and a fourth wall portion opposed to the second wall portion are formed at the rear end of the operation knob with the recess interposed therebetween, and wherein, during a non-operation of the operation knob, a front end of the first wall portion and a front end of the third wall portion are in contact with each other, or a front end of the second wall portion and a front end of the fourth wall portion are in contact with each other.

5. A switch device comprising:

an upper case;

a hollow tube that is vertically opened and provided on an upper surface of the upper case;

an operation knob that is swingably supported by the tube so as to cover an upper opening of the tube; and a lower case that is fitted in the upper case, wherein the tube comprises a front sidewall and a back sidewall, wherein the front sidewall and the back sidewall are opposed in front-back direction with the upper opening interposed therebetween, wherein a drain groove extending along the back sidewall is formed at an upper end of the back sidewall, wherein one of or both ends in a lengthwise direction of the drain groove are opened, wherein the upper end of the back sidewall is opposed to a rear end of the operation knob, wherein the drain groove is covered with the rear end of the operation knob wherein a recess opposed to the drain groove is formed at the rear end of the operation knob wherein a first wall portion and a second wall portion are formed at the upper end of the back sidewall with the drain groove interposed therebetween, and wherein a third wall portion opposed to the first wall portion and a fourth wall portion opposed to the second wall portion are formed at the rear end of the operation knob with the recess interposed therebetween, and wherein, during a non-operation of the operation knob, a front end of the first wall portion and a front end of the third wall portion are in contact with each other, and a front end of the second wall portion and a front end of the fourth wall portion are in contact with each other.

* * * * *